US011075485B2

(12) United States Patent
Pillet

(10) Patent No.: US 11,075,485 B2
(45) Date of Patent: Jul. 27, 2021

(54) CONTACT DEVICE ADAPTED TO FACILITATE THE REPAIR OF BOLTED ELECTRICAL CONNECTIONS

(71) Applicant: AMC, Saint Raphael (FR)

(72) Inventor: Michel Pillet, Saint Raphael (FR)

(73) Assignee: AMC, Saint Raphael (FR)

( * ) Notice: Subject to any disclaimer, the term of this patent is extended or adjusted under 35 U.S.C. 154(b) by 0 days.

(21) Appl. No.: 16/763,107

(22) PCT Filed: Nov. 13, 2018

(86) PCT No.: PCT/FR2018/000249
§ 371 (c)(1),
(2) Date: May 11, 2020

(87) PCT Pub. No.: WO2019/092330
PCT Pub. Date: May 16, 2019

(65) Prior Publication Data

US 2020/0350727 A1 Nov. 5, 2020

(30) Foreign Application Priority Data

Nov. 13, 2017 (FR) ..... 1771210

(51) Int. Cl.

| | |
|---|---|
| ***H01R 13/621*** | (2006.01) |
| ***B22F 7/00*** | (2006.01) |
| ***H01R 4/30*** | (2006.01) |
| ***H01R 13/03*** | (2006.01) |

(52) U.S. Cl.
CPC ..... *H01R 13/621* (2013.01); *B22F 7/006* (2013.01); *H01R 4/304* (2013.01); *H01R 13/03* (2013.01)

(58) Field of Classification Search
CPC ..... B22F 7/006; H01R 13/621; H01R 4/304
See application file for complete search history.

(56) References Cited

U.S. PATENT DOCUMENTS

| | | | | |
|---|---|---|---|---|
| 5,360,355 | A | 11/1994 | Ehrler et al. | |
| 7,229,296 | B2 * | 6/2007 | Pillet | H01R 4/304 439/86 |
| 7,547,228 | B1 | 6/2009 | Schlarman | |
| 9,093,778 | B2 | 7/2015 | Pillet | |
| 9,679,706 | B2 | 6/2017 | Pillet | |
| 9,748,014 | B2 | 8/2017 | Pillet | |
| 2006/0051990 | A1 | 3/2006 | Pillet | |

FOREIGN PATENT DOCUMENTS

| | | |
|---|---|---|
| EP | 0136211 A2 | 4/1985 |
| FR | 2847391 A1 | 5/2004 |

* cited by examiner

*Primary Examiner* — Ross N Gushi
(74) *Attorney, Agent, or Firm* — James C. Lydon

(57) ABSTRACT

Contact device adapted to be inserted between two contact surfaces of two conductors of an electrical connection provided with at least one bolt, the device being formed by a metal foam plate to reduce electrical resistance of the connection. The surface area of the metal foam plate is at least equal to the surface area in contact with the two conductors, and is approximately 1 to 2 mm thick. The metal foam plate includes at least one circular opening intended to contain the bolt and at least one first pre-cut located between the opening and an outer edge of the contact device. The pre-cut is made by cutting the foam plate over a part of its thickness so that it can be easily broken along the pre-cut, the pre-cut allowing the bolt to be passed through it during the installation of the contact device.

11 Claims, 4 Drawing Sheets

CONTACT DEVICE ADAPTED TO FACILITATE THE REPAIR OF BOLTED ELECTRICAL CONNECTIONS

TECHNICAL FIELD OF THE INVENTION

The present invention relates to the technical field of electrical connections and devices which make it possible to improve the electrical conductivity through these connections and relates in particular to a contact device adapted to facilitate the repair of bolted electrical connections.

BACKGROUND ART

In the field of power engineering, electrical connections are subject to high currents and high temperatures. When the contact surfaces deteriorate due to erosion or oxidation, the electrical contacts heat up and electrical losses increase over time. Their renovation is essential. As a general rule, maintenance is also necessary for all electrical connections where metal parts are in contact and not only for connections through which large currents flow. The contact device described in applications No. WO2004049515 and WO2012007701 makes it possible to improve the electrical conductance of the electrical connections and to slow down the degradation of the contacting surfaces. To be as efficient as possible, the contact surface of the contact device must be the same size as that of the electrical connection. In the case of a bolted electrical connection, the contact device has a circular opening so as to pass the bolt through it. The installation of the contact device therefore requires complete disassembly of the bolted connection. Likewise, in the case of a traditional routine maintenance operation such as re-machining of the contacting surfaces, the contact must be completely disassembled.

When these connections are placed high up, on transformer outlets or in positions that are difficult to access, the risk of losing nuts, washers or bolts is increased. In addition, the wearing of mandatory safety equipment such as gloves and harnesses restricts the manual ability of the operator. It is estimated that the proportion of sites affected by the hazards of dropped clamping elements is between 10 and 20%. In addition, a clamping element dropped into an electrical system can cause a short circuit, requiring that the installation be shut down in order to search for and extract it. The loss of time and the resulting production stoppage can be very significant and very costly. In addition, the widespread use of non-magnetic aluminum or stainless steel bolts, limiting overheating in alternating current applications, prevents them from being extracted from inaccessible places using a magnet, which further complicates the extraction operation. This drop risk is so great that routine maintenance actions are dealt with for electrical connections that heat up to 100° C. and above, and are postponed for the others. As a result, the average temperature of the circuits is high, which reduces the electrical efficiency since the resistance of copper or aluminum increases by 40% for 100° C. The high temperature of the circuits contributes to the degradation of the electrical contacts, greatly reduces safety and contributes to a self-degrading system.

In addition, when it comes to placing a metallic foam conductive element between the two contact surfaces of the faulty electrical connection, the operator must also loosen and remove the bolt with the risk of losing contact elements. In addition, the cables and bars carried by the connections can be heavy, and holding them during a complete disconnection can require significant efforts and bulky handling equipment in areas often difficult to access.

SUMMARY OF THE INVENTION

This is why the object of the invention is to provide a contact device for improving the bolted electrical connections and lowering their temperature, the installation of which does not require the complete disassembly of the contact.

The object of the invention is therefore a contact device adapted to be inserted between the two contact surfaces of two conductors of an electrical connection provided with at least one bolt, the device being formed by a metal foam plate which is highly porous and deformable in order to reduce the electrical resistance of the connection. According to the general features of the invention:

- the surface area of the metal foam plate is at least equal to the contact surface area of the two conductors,
- the metal foam plate comprises at least one circular opening intended to contain the bolt and at least one first pre-cut located between the opening and an outer edge of the contact device, the pre-cut being made by cutting the foam plate over a part of its thickness so as to weaken it and make it easily frangible along the pre-cut, the pre-cut allowing the bolt to be passed through it during the installation of the contact device between the two contact surfaces of the two conductors.

BRIEF DESCRIPTION OF THE DRAWINGS

The purposes, objects and characteristics of the invention will become more apparent from the following description when taken in conjunction with the accompanying drawings in which.

DETAILED DESCRIPTION OF THE INVENTION

Figure 1:
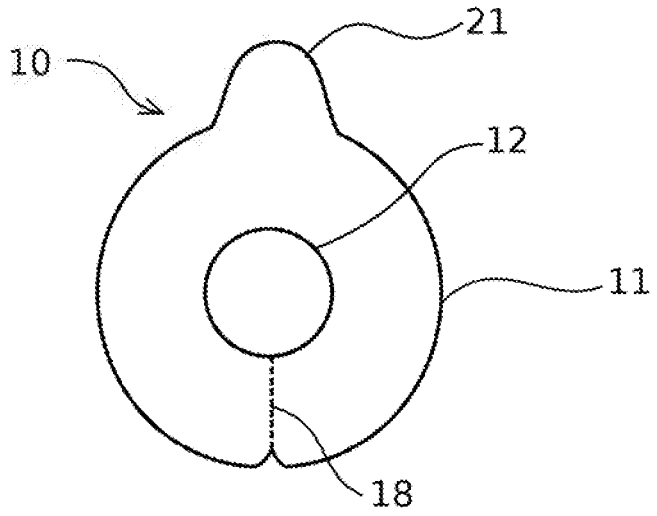
FIG. 1 represents the device according to the invention according to a first preferred embodiment.

Referring to FIG. 1, the device according to the invention is a contact device 10 consisting of a metal foam plate 11 known under the name ECOCONTACT (registered trademark) which is circular in shape. The metal foam plate 11 comprises an opening 12 and at least one first pre-cut 18.

The pre-cut 18 forms a straight segment, the first end of which is located on the edge of the opening 12 and the second end of which is located on the lower outer edge of the foam plate 11. A gripping means 21 located outside the circular surface and along the outer edge of the foam plate 11 allows the element 10 to be taken in hand.

Figure 2:
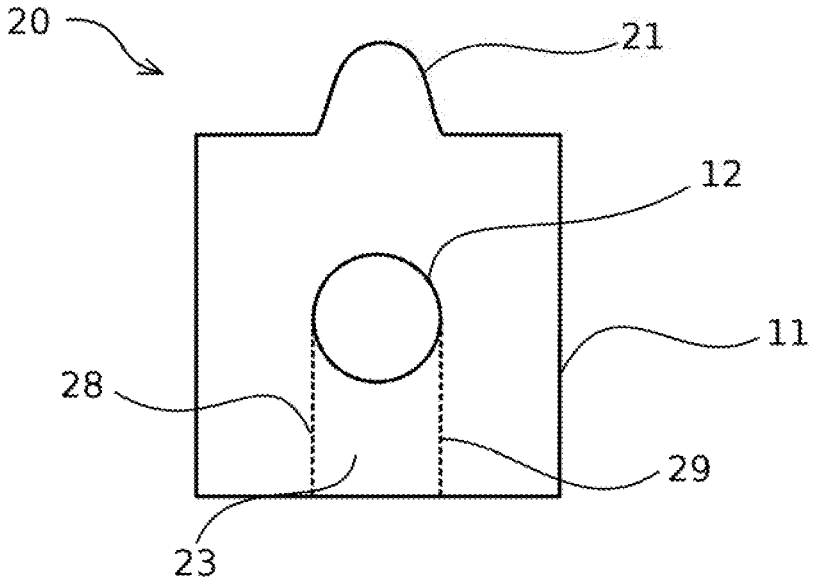
FIG. 2 represents the device according to the invention according to a second embodiment.

FIG. 2 illustrates a second embodiment of the device according to the invention. The device according to the invention is a contact device 20 consisting of a metal foam plate 11 which is rectangular in shape. The metal foam plate 11 comprises a circular opening 12, a first pre-cut 28 and a second pre-cut 29. The two pre-cuts 28 and 29 form two segments, the first ends of which are located on the edge of the opening 12 and the second ends of which are located on the lower outer edge of the foam plate 11. In addition, the pre-cuts 28 and 29 are parallel and separated by a distance which is preferably equal to the diameter of the opening 12. A gripping means 21, located outside the rectangular surface and along the upper edge of the foam plate 11, allows the element 20 to be taken in hand.

In the two embodiments described above and in the following description, making a pre-cut consists in cutting the foam over a part of its thickness so as to weaken it and make it easily frangible along the pre-cut. The pre-cuts are made by laser, pressing, punching or any other means.

In the second embodiment, the part of the foam plate delimited by the two pre-cuts 28 and 29, by a part of the edge of the opening 12 and by a part of the lower edge of the foam plate forms a detachable piece of foam 23.

Figure 3:
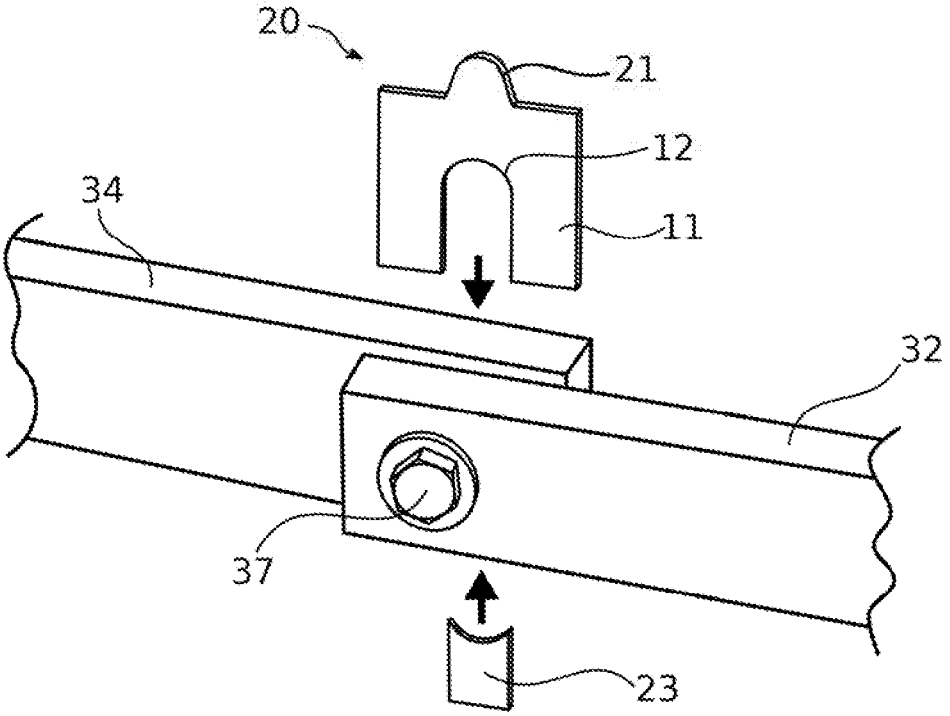
FIG. 3 represents the installation of the device according to the invention according to the second embodiment in a bolted electrical connection.

As can be seen in FIG. 3, the contact device 20 is designed to be inserted between two conductors 32 and 34 electrically connected by tight contact by means of a tightening means such as a tightening bolt 37 passing through the two conductors as well as the foam plate 11 via the opening 12. The shape of the foam plate corresponds to the shape of the contacting surfaces of the two conductors. Thus, for each bolted electrical connection, the size and shape of the foam plate are adapted to the contact surface of the electrical connection. The gripping means 21 is of any shape provided that it protrudes from the electrical connection when the contact device is inserted between the contacting surfaces of the electrical connection. So, for all the embodiments described, the gripping means is located outside the surface of the foam plate 11 intended to come into contact with the contact surfaces of the two conductors of the electrical connection.

Figure 4:
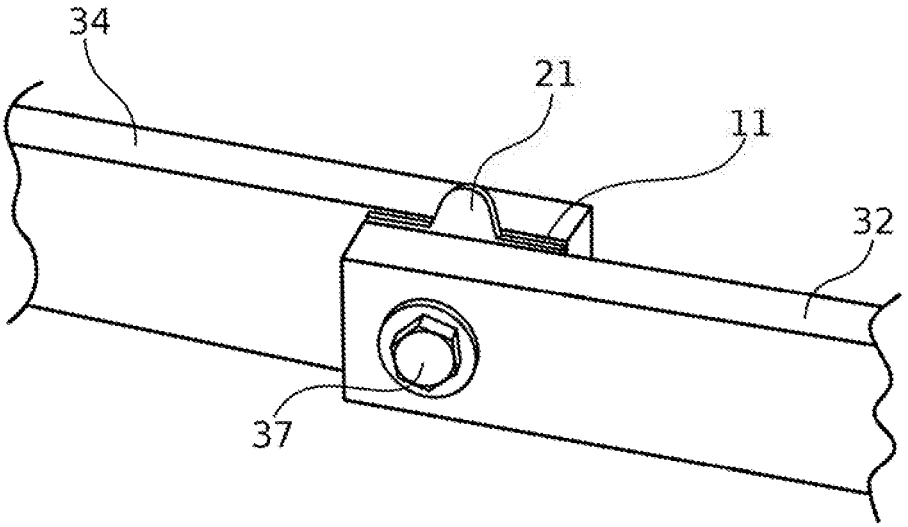
FIG. 4 represents a bolted electrical connection equipped with the device according to the invention according to the second embodiment.

To insert the contact device 20 between the two conductors 32 and 34, the bolt has been loosened in order to move the conductors apart by a distance at least equal to the thickness of the foam, and the detachable piece of foam 23 has been removed from the foam plate 11. To install the contact device 20 between the two conductors, the operator holds it by its gripping device 21 and inserts the contact device 20 astride the bolt 37 until the bolt is positioned in the opening 12. The operator can also insert the piece 23 in the space left free between the pre-cuts 28 and 29 and tighten the bolt 37. Once these operations have been carried out, only the gripping device 21 of the contact device 20 protrudes from the electrical connection as can be seen in FIG. 4.

Figure 5:
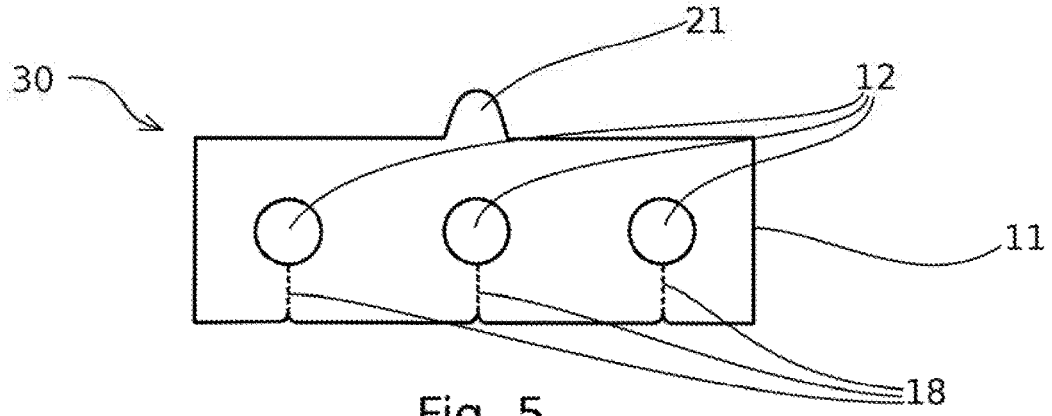
FIG. 5 represents the device according to the invention according to a variant of the first embodiment.

FIG. 5 represents an alternative embodiment of the first embodiment intended for a contact surface of an electrical connection with several bolts. In the example shown, the device according to the invention is a contact device 30 consisting of a metal foam plate 11 which is rectangular in shape. The metal foam plate 11 comprises three openings 12 and at least one first pre-cut 18 per opening. Each pre-cut 18 is a straight segment the first end of which is located on the edge of one of the openings 12 and the second end of which is located on the outer edge of the foam plate 11. A pre-cut 18 is connected to each opening. A gripping means 21 located outside the rectangular surface of the foam plate 11 allows the element 30 to be taken in hand. Along the pre-cut 18 and on the side of its second end, the foam plate may also have two rounded angles as shown in FIG. 5.

Figure 6:
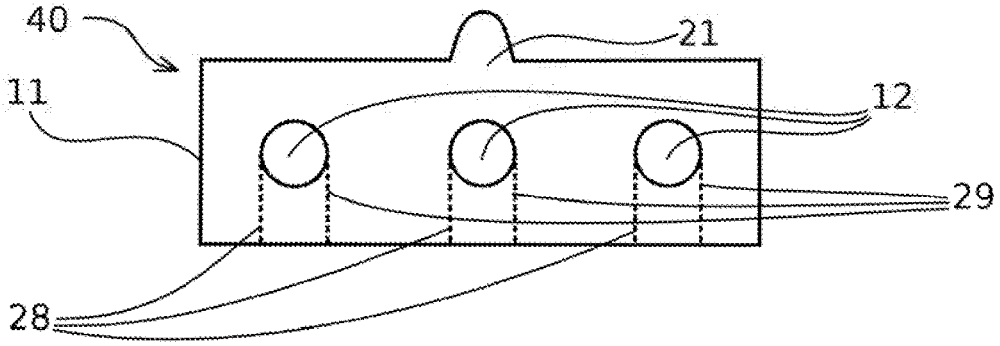
FIG. 6 represents the device according to the invention according to a variant of the second embodiment.

Likewise, FIG. 6 represents an alternative embodiment of the second embodiment intended for a contact surface of an electrical connection with several bolts. The device according to the invention is a contact device 40 consisting of a metal foam plate 11 which is rectangular in shape. The metal foam plate 11 comprises three circular openings 12 and at least one first pre-cut 28 and a second pre-cut 29 per opening 12. For each opening 12, the two pre-cuts 28 and 29 are straight segments the first end of which is located on the edge of the opening 12 and the second end of which is located on the lower edge of the foam plate 11. The pre-cuts 28 and 29 are parallel and separated by a distance which is preferably equal to the diameter of the opening 12. The contact device 40 also includes a gripping element 21.

Figure 7:
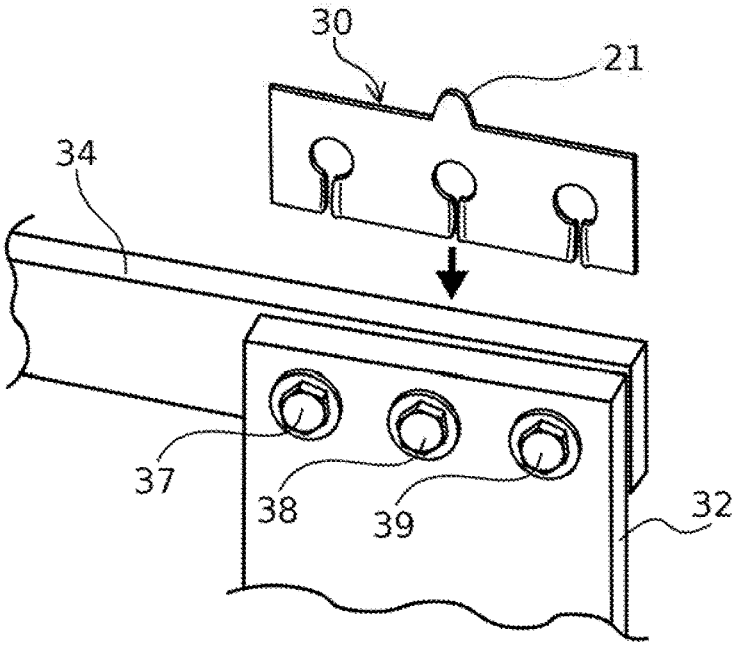
FIG. 7 represents the installation of the device according to the invention in an electrical connection provided with three bolts according to the first embodiment.

FIG. 7 represents the installation of the device according to the invention in an electrical connection provided with three bolts according to the first embodiment shown in FIG. 5, According to FIG. 7, the contact device 30 is inserted between the two conductors 32 and 34. For this, the bolts 37, 38 and 39 were loosened in order to move the conductors by a distance at least equal to the thickness of the foam, and the foam plate was cut over its entire thickness along each pre-cut 18. To install the contact device 30 between the two conductors, the operator moves apart and slightly bends the two parts of foam on either side of each old pre-cut 18 so as to move apart their edges so that a bolt can pass between them. The operator holds the contact device 30 by its gripping device 21 and inserts it between the two conductive elements 32 and 34, each opening 12 straddling the bolts 37, 38 and 39. The contact device is installed when each bolt is placed in an opening 12. The operator then tightens the bolts and, while the two contact surfaces of the conductors 32 and 34 get closer, the foam plate 11 gets flattened and the slightly bent edges of the parts on either side of each old pre-cut 18 get also flattened and cover the entire contact surface of the connection. Once these operations have been carried out, only the gripping device 21 of the contact device 30 protrudes from the electrical connection.

Figure 8:
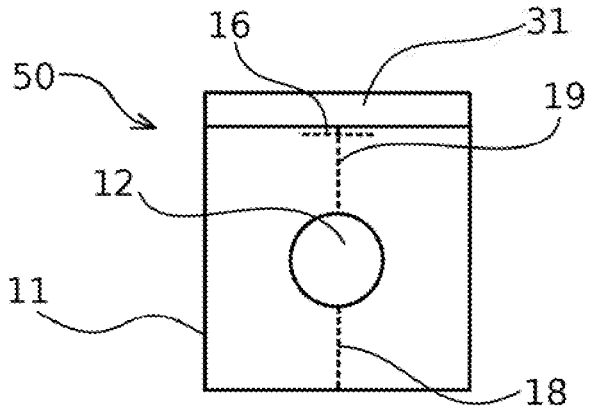
FIG. 8 represents the device according to the invention according to a third embodiment.

According to FIG. 8 showing a third embodiment of the invention, the contact device 50 consists of a metal foam plate 11 which is rectangular in shape. The metal foam plate 11 comprises an opening 12, a first pre-cut 18 and at least a second pre-cut 19. The pre-cut 18 is a straight segment the first end of which is located on the edge of the opening 12 and the second end of which is located on the lower outer edge of the foam plate 11. The pre-cut 19 is located in the extension of the pre-cut 18. The pre-cut 19 is a straight segment the first end of which is located on the edge of the opening 12 and the second end of which is located on the upper outer edge of the foam plate 11. A gripping means 31 located outside the rectangular surface of the foam plate 11 allows the element 50 to be taken in hand. In addition, the gripping means 31 is located on the upper outer edge of the contact device 50 and holds the foam plate even when it is cut over the entire length of the pre-cuts 18 and 19. The foam plate may also include an additional pre-cut 16 parallel to the edge carrying the gripping means 31 and close to the latter. This pre-cut 16 is preferably perpendicular to the pre-cut 19.

Figure 9:
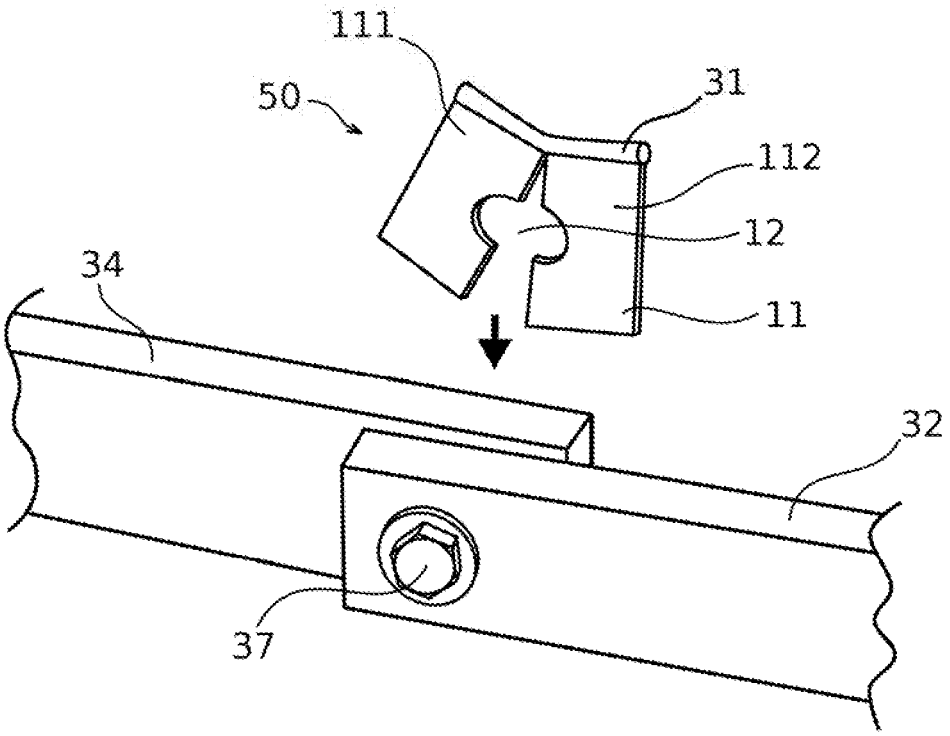
FIG. 9 represents the installation of the device according to the invention according to the third embodiment in a bolted electrical connection.

With reference to FIG. 9, the contact device 50 is inserted between the two conductors 32 and 34. For this, the bolt 37 has been loosened in order to move the conductors apart by a distance at least equal to the thickness of the foam. The foam plate 11 has been cut over its entire thickness along the pre-cuts 18 and 19 and comprises two parts of foam 111 and 112 held together by the gripping means 31. The gripping means 31 is also a means for articulating the two parts of foam 111 and 112 relative to one another and for moving them apart from one another to insert them between the conductors astride the bolt 37. This embodiment is particularly suitable and advantageous when the spacing between the two surfaces of the electrical connection cannot be made greater than the thickness of the foam without a risk of losing the nut. The gripping means plays the role of a hinge and is made of an elastic and preferably electrically non-conductive material such as rubber. If necessary, the foam sheet can also be cut along its additional pre-cut 16 so as to further facilitate the insertion of the foam plate between the two contact surfaces of the two conductors. Whatever the embodiment of the invention, the gripping means 21 and 31 protrude from the electrical connection when the contact device is inserted between the contacting surfaces of the electrical connection. Therefore, the gripping means 21 and 31 is a means for visually identifying the electrical connections equipped with metal foam. In addition, the gripping means 21 and 31 can be used as a referencing means by entering therein a lot number, a date or a reference to another datum. The gripping means 21, 31 can also be equipped with a temperature indicator so as to provide an indication of the temperature reached in the electrical connection and in particular when the maximum allowed temperature is reached in the electrical connection. The temperature indicator can be a strip that changes color depending on the temperature.

The metal foam of the contact devices 10, 20, 30, 40 and 50 is an open cell foam composed of a metal foam skeleton chosen from the group consisting of iron, cobalt, nickel and their alloys directly coated with at least a metallic coating such as a coating of tin, indium or one of their alloys. The foam is obtained according to the production methods described in application WO2012007701. The structure of the foam 10 thus obtained is cellular and its physical properties are mainly a high porosity and deformability, which has the effect of reducing the electrical resistance of the connection, as well as a low density in the order of 400 $g/m^2$. The thickness of the metal foam plates of the devices according to the invention is in the order of 1 to 2 mm.

One of the advantages of the device according to the invention is that it durably lowers the temperature of the electrical connections. The result is improved electrical efficiency, slower degradation of electrical circuits and increased safety.

In addition, the contact device according to the invention has the advantage of providing the user with the choice of its use. Indeed, the contact device according to the invention consists of a foam plate having three functions in one because the user has the choice between three alternatives:

- cutting the foam plate along a pre-cut and thus obtain a foam plate with a suitable cut to be able to introduce the device without completely unscrewing the bolted connection,
- cutting the foam plate along several pre-cuts and thus obtain a foam plate with a suitable cut to facilitate the introduction of the device into the bolt connection not completely unscrewed,
- not cutting the foam plate along the pre-cut and thus use the entire foam plate while benefiting from a foam plate whose electrical conductivity was not interrupted by a cut.

A simple cut in place of a pre-cut would not allow these alternatives. In addition, if the pre-cuts of the embodiments of FIGS. 2, 3, 5 and 6 were replaced with cutouts, the result would no longer be a one-piece contact device but a contact device made of several pieces with the resulting disadvantages: risk of loss and incomplete contact device which does not cover the entire surface of the connection.

The invention claimed is:

1. A contact device (10, 20, 30, 40, 50) adapted to be inserted between the two contact surfaces of two conductors (32 and 34) of an electrical connection provided with at least one bolt (37, 38, 39), said device comprising a metal foam plate (11) with high porosity and deformability in order to reduce the electrical resistance of the connection such that

- the surface area of said metal foam plate is at least equal to the contacting surface area of said two conductors,
- said metal foam plate comprises at least one circular opening (12) intended to contain the bolt and at least one first pre-cut (18, 28) located between said opening and an outer edge of the contact device, said pre-cut being made by cutting the foam plate over a part of its thickness so as to weaken it and make it easily frangible along said pre-cut, said pre-cut allowing the bolt to be passed through it during the installation of said contact device between the two contact surfaces of said two conductors.

2. The contact device (10, 20, 30, 40, 50) according to claim 1 comprising a gripping means (21, 31) located outside the surface of said foam plate (11) adapted to come into contact with the contact surfaces of said two conductors.

3. The contact device (50) according to claim 2 comprising two pieces of foam (111 and 112) held together by said gripping means (31) after said foam plate (11) has been cut along said two pre-cuts (18 and 19).

4. The contact device (50) according to claim 3, wherein said gripping means (31) is made of an elastic material.

5. The contact device (50) according to claim 4, wherein said elastic material is an electrically non-conductive material.

6. The contact device (50) according to claim 5, wherein said electrically non-conductive material is rubber.

7. The contact device (10, 20, 30, 40, 50) according to claim 2, wherein said gripping means (21, 31) includes a means for giving information on the electrical connection equipped with said contact device.

8. The contact device (10, 20, 30, 40, 50) according to claim 7, wherein said gripping means (21, 31) is equipped with a temperature indicator so as to provide an indication of the temperature reached in the electrical connection.

9. The contact device (20, 40) according to claim 1, comprising two pre-cuts (28, 29) each forming a straight segment, a first end of which is located on the edge of said opening (12) and the second end of which is located on the outer edge of said foam plate, the pre-cuts (28, 29) being spaced apart by a distance equal to the diameter of said opening, the part of said foam plate delimited by said two pre-cuts (28, 29), a part of the edge of said opening (12) and a part of the edge of said foam plate forming a piece of detachable foam (23), each of pre-cuts being made by cutting said foam sheet over a part of its thickness so as to weaken it and make it easily frangible along said pre-cut.

10. The contact device (50) according to claim 1, comprising a second pre-cut (19) located in the extension of the first pre-cut (18), the pre-cut (19) being a straight segment the first end of which is located on the edge of said opening (12) and the second end of which is located on the upper outer edge of said foam plate (11), said pre-cut (19) being made by cutting said foam sheet over a part of its thickness so as to weaken it and make it easily frangible along said pre-cut (19).

11. The contact device (50) according to claim 10, wherein said foam plate comprises an additional pre-cut (16) parallel to the edge carrying said grip means (31) and close to it so as to further facilitate inserting the foam plate between the two contact surfaces of said two conductors.

* * * * *